US009945365B2

(12) United States Patent
Hernandez et al.

(10) Patent No.: US 9,945,365 B2
(45) Date of Patent: Apr. 17, 2018

(54) FIXED FREQUENCY HIGH-PRESSURE HIGH RELIABILITY PUMP DRIVE

(71) Applicant: BJ Services, LLC, Tomball, TX (US)

(72) Inventors: Jennifer Hernandez, Tomball, TX (US); Bruce A. Vicknair, The Woodlands, TX (US); Blake C. Burnette, Tomball, TX (US)

(73) Assignee: BJ Services, LLC, Tomball, TX (US)

( * ) Notice: Subject to any disclaimer, the term of this patent is extended or adjusted under 35 U.S.C. 154(b) by 843 days.

(21) Appl. No.: 14/254,057

(22) Filed: Apr. 16, 2014

(65) Prior Publication Data

US 2015/0300336 A1 Oct. 22, 2015

(51) Int. Cl.

| | |
|---|---|
| ***F04B 17/03*** | (2006.01) |
| ***F04B 47/02*** | (2006.01) |
| ***E21B 43/26*** | (2006.01) |

(52) U.S. Cl.

CPC ..... *F04B 17/03* (2013.01); *F04B 47/02* (2013.01); *E21B 43/26* (2013.01)

(58) Field of Classification Search

CPC ..... F04B 17/03; F04B 47/02; E21B 43/26; E21B 43/162; E21B 41/00

See application file for complete search history.

(56) References Cited

U.S. PATENT DOCUMENTS

| | | | |
|---|---|---|---|
| 81,513 | A | 8/1868 | Lapham |
| 871,513 | A | 9/1905 | Lohr |
| 1,263,992 | A | 4/1918 | Alexanderson |
| 1,423,090 | A | 7/1922 | Delano |
| 1,442,220 | A | 1/1923 | Kelly |
| 1,549,698 | A | 8/1925 | Williams |
| 2,000,713 | A | 5/1929 | Norris |
| 1,719,889 | A | 7/1929 | Kelsey |
| 1,743,760 | A | 1/1930 | Eaton |
| 1,754,779 | A | 4/1930 | Thurston |
| 1,905,735 | A | 4/1933 | Morrill |
| 2,023,326 | A | 12/1935 | Kilbourne |
| 2,061,983 | A | 12/1936 | Rossman |
| 2,406,781 | A | 9/1946 | Lewis |
| 2,508,180 | A | 5/1950 | Mahnke et al. |
| 3,543,038 | A | 11/1970 | Putz et al. |
| 3,584,980 | A | 6/1971 | Cawley et al. |
| 4,048,528 | A | 9/1977 | Whitney |
| 4,644,242 | A | 2/1987 | Takata et al. |

(Continued)

OTHER PUBLICATIONS

Puchstein, A. F., et al., "Alternating-Current Machines", 2nd edition, Ninth Printing, Apr. 1949. 6 pages.

(Continued)

*Primary Examiner* — Michael R Wills, III

(74) *Attorney, Agent, or Firm* — Bracewell LLP; Constance G. Rhebergen; Keith R. Derrington

(57) ABSTRACT

An apparatus configured to hydraulically fracture an earth formation, includes a pump configured to hydraulically fracture the earth formation by pumping a fracturing liquid into a borehole penetrating the earth formation and an electric motor having a rotor coupled to the pump and a stator. A motor control center is configured to apply an alternating electrical voltage having a fixed-frequency to the stator in order to power the electric motor, wherein the apparatus and motor control center do not have a variable frequency drive.

19 Claims, 4 Drawing Sheets

(56) References Cited

U.S. PATENT DOCUMENTS

| | | | | |
|---|---|---|---|---|
| 7,417,333 | B2 * | 8/2008 | Miller | H02J 3/1871 290/44 |
| 2007/0096571 | A1 * | 5/2007 | Yuratich | E21B 43/128 310/87 |
| 2008/0074076 | A1 * | 3/2008 | Fisher | H02P 27/04 318/802 |
| 2010/0090633 | A1 * | 4/2010 | Deller | H02K 29/08 318/400.39 |
| 2013/0147410 | A1 * | 6/2013 | Head | H02P 27/047 318/400.42 |
| 2013/0175030 | A1 * | 7/2013 | Ige | E21B 43/128 166/250.15 |
| 2014/0010671 | A1 * | 1/2014 | Cryer | B60W 10/30 417/53 |
| 2014/0096974 | A1 * | 4/2014 | Coli | E21B 43/26 166/358 |
| 2014/0138079 | A1 * | 5/2014 | Broussard | E21B 43/26 166/66.4 |
| 2015/0027712 | A1 * | 1/2015 | Vicknair | E21B 43/162 166/305.1 |
| 2015/0114652 | A1 * | 4/2015 | Lestz | E21B 43/26 166/308.1 |
| 2015/0155805 | A1 * | 6/2015 | Iwaji | H02P 21/18 318/400.33 |
| 2015/0252661 | A1 * | 9/2015 | Glass | E21B 43/267 166/308.1 |

OTHER PUBLICATIONS

Shoults, D.R, et al., "Electric Motors in Industry", Third Printing, Sep. 1946. 24 pages.

Voith, "Fluid coupling type TV", Dec. 13, 2013, 3 pages, http://www.voith.com/en/products-services/power-transmission/fluid-couplings/fluid-coupling-type-tv-42862.html.

* cited by examiner

FIXED FREQUENCY HIGH-PRESSURE HIGH RELIABILITY PUMP DRIVE

BACKGROUND

Hydraulic fracturing is a common technique for extracting hydrocarbons from reservoirs in earth formations. In hydraulic fracturing, certain types of liquids are injected into boreholes that penetrate the earth formations at pressures that are high enough to fracture the formation rock. The fractured rock creates spaces that are interconnected and allow the hydrocarbons of interest to flow for extraction purposes.

In order to create a large number of fractures needed to extract the hydrocarbons, high pressure and high flow pumps are required to inject the fracturing liquids. For example, the pumps may be required to pump over 70 gallons per second of the liquid at pressures over 15,000 psi and require over 2000 hp to run at these specifications. In many instances, electric motors may be called upon to operate these types of pumps.

Hydraulic fracturing operations can be very expensive and any down time can only increase the operating costs. Hence, reliable electric motors to operate fracturing pumps would be well received in the hydraulic fracturing industry.

BRIEF SUMMARY

Disclosed is an apparatus configured to hydraulically fracture an earth formation. The apparatus includes: a pump configured to hydraulically fracture the earth formation by pumping a fracturing liquid into a borehole penetrating the earth formation; an electric motor having a rotor coupled to the pump and a stator; and a motor control center configured to apply an alternating electrical voltage having a fixed-frequency to the stator in order to power the electric motor, wherein the apparatus and motor control center do not have a variable frequency drive.

Also disclosed is a method for performing hydraulic fracturing of an earth formation. The method includes applying a fixed-frequency voltage to a stator of an electric motor having a rotor coupled to a pump configured to pump a liquid into a borehole penetrating the earth formation. The fixed frequency voltage is applied without using a variable frequency drive. The method further includes pumping the liquid into the earth formation using the pump to hydraulically fracture the earth formation.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein by way of exemplification and not limitation with reference to the figures.

Disclosed are embodiments of apparatus configured to hydraulically fracture an earth formation.

Figure 1:
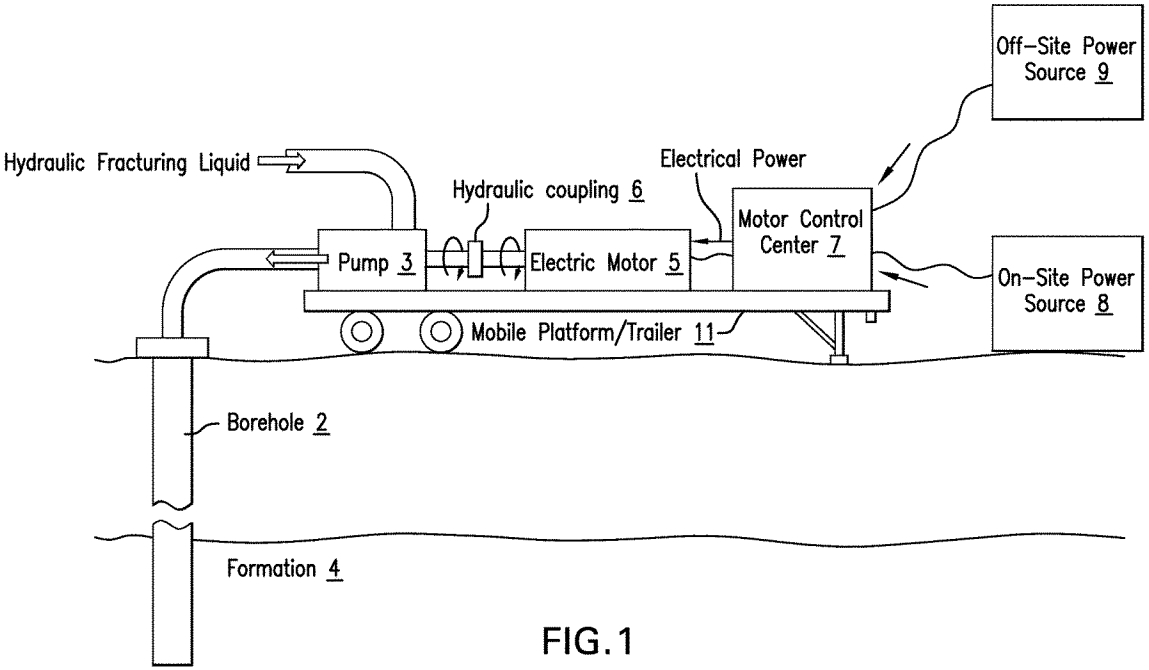
FIG. 1 illustrates a schematic representation of an exemplary embodiment of a hydraulic fracturing system.
Figure 4A:
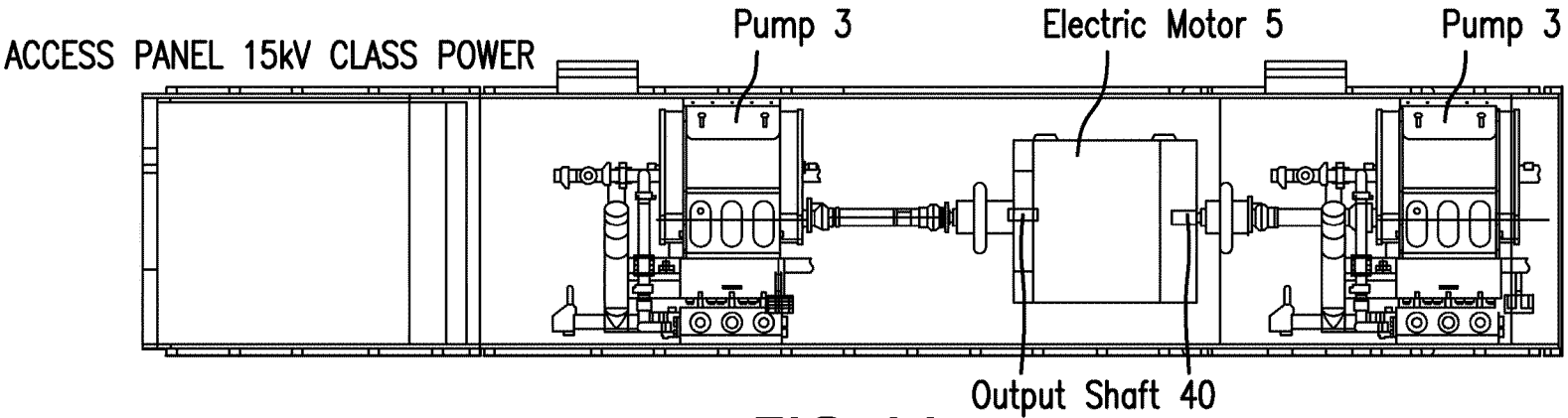
FIGS. 4A and 4B, collectively referred to as FIG. 4, depicts aspects of one electric motor having dual output shafts driving two separate hydraulic fracturing pumps.
Figure 4B:
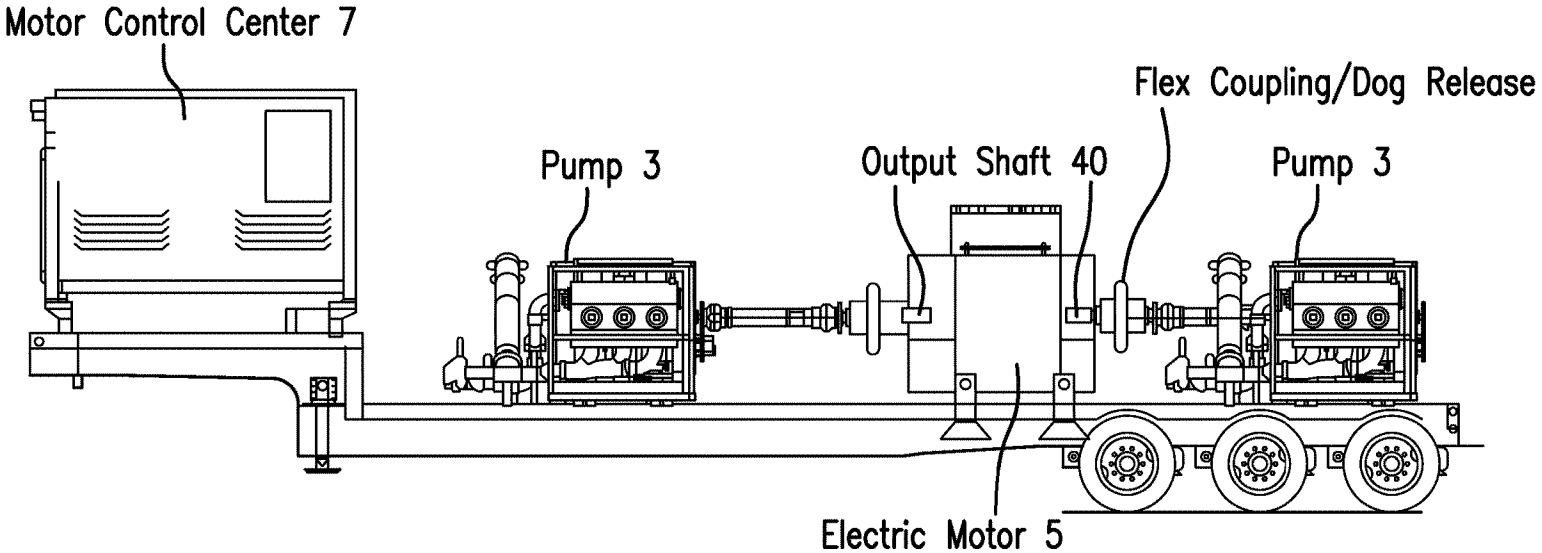

FIG. 1 illustrates a representation of an exemplary embodiment of a hydraulic fracturing system 10. The hydraulic fracturing system 10 is configured to inject fracturing fluid into an earth formation 4 via borehole 2 in order to fracture rock in that formation. The fractured rock creates spaces through which hydrocarbons can flow for extraction purposes. A pump 3 is configured to pump the fracturing liquid into the borehole 2. In general, the pump 3 can generate pressures over 15,000 psi with a flow rate exceeding 70 gallons per second. The pump 3 is driven by an electric motor 5. The electric motor 5 may be rated for over 2,000 hp in order for the pump 3 to generate the high pressure and flow rate. A hydraulic coupling 6 may be disposed between the pump 3 and the electric motor 5 such as being coupled to an input shaft of the pump 3 and an output shaft of the electric motor 5. The hydraulic coupling 6 uses a fluid and a mechanical component that interacts with the fluid to transmit power from the motor output shaft to the pump input shaft and can reduce the starting load on the motor 5 thereby reducing the start-up current required by the motor 5. The electric motor 5 is controlled by a motor control center (MCC) 7. The motor control center 7 is configured to control operation of the electric motor 5. Motor operations may include starting and stopping the motor, changing rotational motor speeds, and dynamically braking the motor and thus the pump. Electric power to the motor control center 7 may be supplied by an on-site power source 8, such as on-site diesel generators or gas turbine generators, or by an off-site power source 9, such as utility grid power. For portability purposes, the pump 3, the electric motor 5, and the MCC 7 are mounted on a mobile platform 11 such as a trailer that may be towed on public roads. It can be appreciated that one or more pumps may be mounted on the mobile platform and that a single electric motor may be coupled to the pumps on the mobile platform. In one or more embodiments referring to FIG. 4, a single electric motor 5 includes two output shafts 40 with each output shaft 40 coupled to and driving one pump 3. FIG. 4A presents a top view while FIG. 4B presents a side view.

Figure 2:
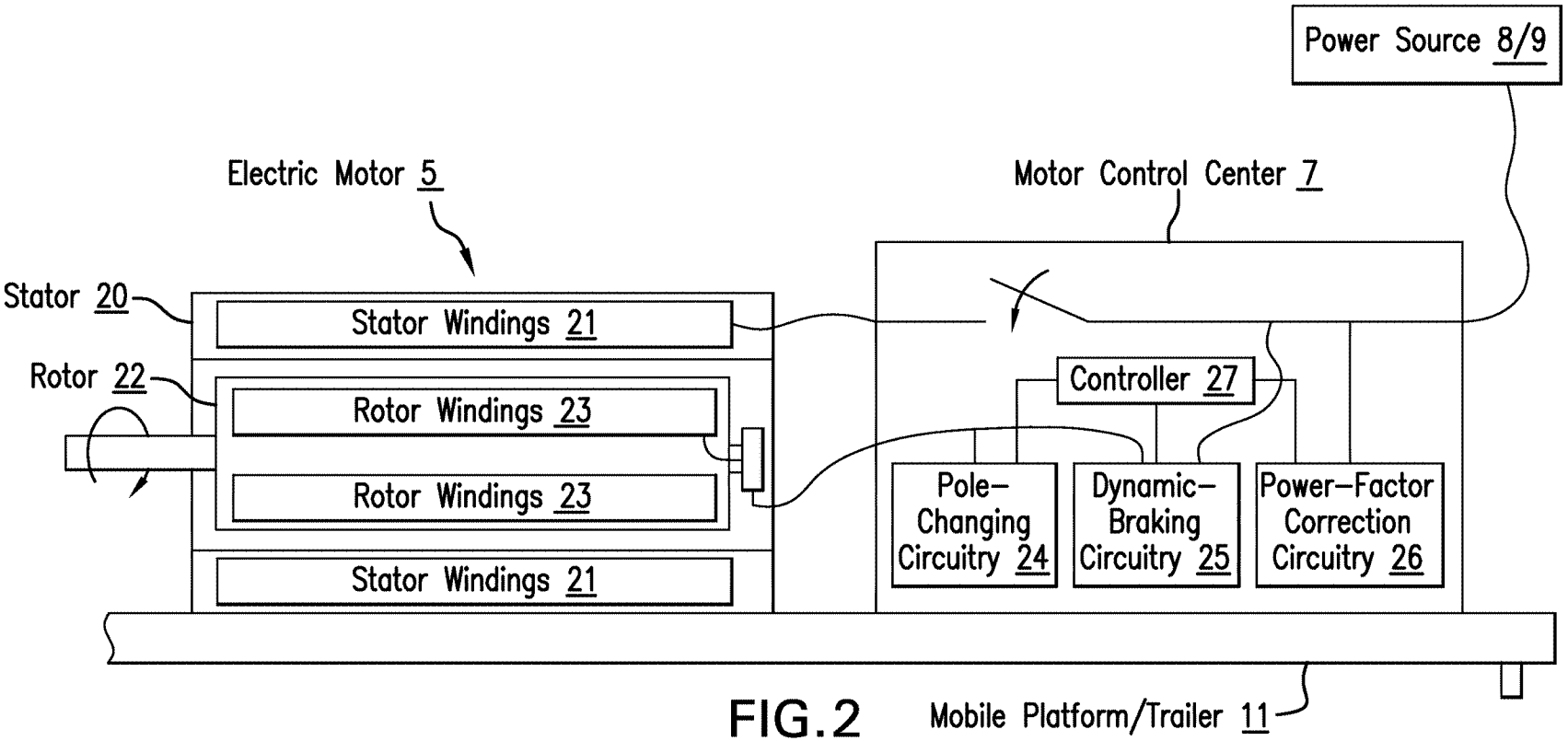
FIG. 2 depicts aspects of a fixed frequency electric motor that is coupled to a hydraulic fracturing pump.

Refer now to FIG. 2. FIG. 2 depicts aspects of the electric motor 5 and the motor control center 7 in a side view. The electric motor 5 includes a stator 20 that has stator windings 21 for generating a rotating magnetic field at a synchronous speed that corresponds to the frequency of a voltage applied to the stator windings 21. The motor 5 also includes a rotor 22 that has rotor windings 23 for interacting with the rotating magnetic field in order to rotate the rotor 22. The rotor windings 23 are configured generate rotating magnetic poles for interacting with the rotating magnetic field. In one or more embodiments, the electric motor 5 is an induction electric motor in which the rotating magnetic poles in the rotor are induced by the rotating magnetic field in the stator. In one or more embodiments, the electric motor 5 is a multi-phase electric motor such as a three-phase motor for example. As disclosed herein, the electric motor 5 has a voltage with a fixed frequency applied to the stator 20 and, hence, the electric motor 5 may be referred to the fixed-frequency motor 5. In other words, the frequency of the voltage applied to the stator 20 does not vary and is thus fixed.

For controlling operation of the electric motor 5, the MCC 7 includes components such as contactors for applying fixed-frequency voltage to the motor 5. These components may be operated locally such as from a local control panel or remotely. The fixed-frequency is the frequency of the voltage supplied by the on-site power source 8 and/or the off-site power source 9. Hence, neither the hydraulic fracturing system 10 nor the MCC 7 includes a variable frequency drive (VFD) for varying the frequency of the voltage applied to the stator 20. In one or more embodiments, the voltage supplied by the on-site power source 8 and/or the off-site power source 9 is applied directly to the stator 20 by the MCC 7 without any intermediate transformer in order to improve reliability.

The MCC 7 may also include pole-changing circuitry 24 configured to change a configuration of the rotor windings 23 in order to change an operating speed of the motor 5. The pole-changing circuitry 24 allows for operating the motor 5 at multiple rotational speeds. In one or more embodiments, the pole-changing circuitry 24 is configured to operate the motor 5 at a first rotational speed upon start-up from zero rotational speed and then to increase the rotational speed to a second rotational speed for continuous pumping operation in order to limit the associated start-up current. In one or more embodiments, the motor 5 may include slip rings for making connections to the rotor windings 23 and the pole-changing circuitry 24 may include switches for changing the configuration of the rotor windings 23. U.S. Pat. No. 4,644,242 discloses one example of pole-changing circuitry for an electric motor.

The MCC 7 may also include dynamic braking circuitry 25 configured to dynamically brake the motor 5 and thus the pump 3. The dynamic braking circuitry 25 may be configured to change the rotor pole configuration and/or apply voltage to the rotor windings to provide the braking capability.

The MCC 7 may also include power-factor correction circuitry 26 configured to reduce the reactive current and power flowing between the electric motor 5 and the power source in order to reduce power losses due to this current flow (i.e., reduce $I^2R$ losses due to the reactive current flow). In that the stator windings generally impose an inductive load, the power-factor correction circuitry 26 may include capacitors and switches (not shown) for switching in capacitors of an appropriate value to counterbalance the inductive load. It can be appreciated that for an electric motor having known specifications the appropriate values of capacitors may be determined by analysis and/or testing.

A controller 27 may be coupled to the pole-changing circuitry 24 and/or the dynamic braking circuitry 25 in order to control operation of the electric motor 5 according to a prescribed algorithm.

Figure 3:
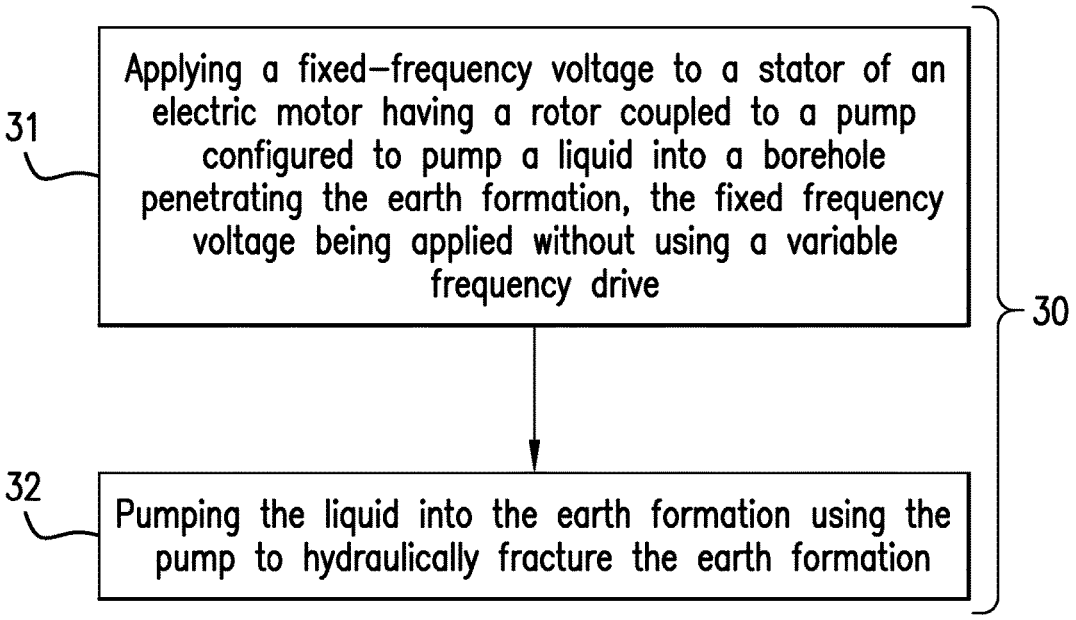
FIG. 3 is flow chart for a method for performing hydraulic fracturing.

FIG. 3 is a flow chart for a method 30 for performing hydraulic fracturing of an earth formation. Block 31 calls for applying a fixed-frequency voltage to a stator of an electric motor having a rotor coupled to a pump configured to pump a liquid into a borehole penetrating the earth formation, the fixed-frequency voltage being applied by a motor control center that does not include a variable frequency drive. Block 32 calls for pumping the liquid into the earth formation using the pump to hydraulically fracture the earth formation. The method 30 may also include turning a hydraulic coupling coupled to the pump with the rotor. The method 30 may also include changing a rotational speed of the motor by switching a configuration of rotor poles using pole-switching circuitry. The method 30 may also include controlling the pole changing circuitry using a controller in order to control a speed of each electric motor in a plurality of electric motors to provide a selected total flow rate that is a sum of all individual pump flow rates of pumps coupled to the plurality of electric motors. The method 30 may also include applying the fixed-frequency alternating electrical voltage supplied by a power source directly to the stator without using an intermediate transformer between the power source and the stator. The method 30 may also include dynamically braking the electric motor in order to reduce rotational speed of the electric motor using dynamic braking circuitry. The method 30 may also include correcting the power-factor of the electric motor using power-factor correction circuitry.

It can be appreciated that use of the fixed-frequency electric motor provides many advantages. A first advantage is that by not using a variable frequency drive (VFD) equipment reliability is increased due to less equipment requirements. A second advantage is that not using a VFD eliminates electrical current harmonics due to semiconductor switching and their potentially damaging effects in the electric motor. A third advantage is that by not having the VFD there is no maintenance requirement for the VFD and no associated costs of a technician trained to maintain the VFD. A fourth advantage is that by not having a VFD and associated cooling components the weight loading on a trailer carrying the pump-motor combination is reduced enabling the trailer to carry more pump and motor weight thus providing increased pumping capacity while at the same time being light enough to be below the legal weight limit for transport over public roads. A fifth advantage is that the fixed-frequency electric motor may be powered directly from a power source thus eliminating the need for an intermediate transformer and the associated costs and inherent additional reliability issues.

In support of the teachings herein, various analysis components may be used, including a digital and/or an analog system. For example, the pole-changing circuitry 24, the dynamic-braking circuitry 25, the power-factor correction circuitry 26, and/or the controller 27 may include digital and/or analog systems. The system may have components such as a processor, storage media, memory, input, output, communications link (wired, wireless, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second" and the like do not denote a particular order, but are used to distinguish different elements. The term "configured" relates to a structural limitation of an apparatus that allows the apparatus to perform the task or function for which the apparatus is configured.

The flow diagram depicted herein is just an example. There may be many variations to this diagram or the steps (or operations) described therein without departing from the spirit of the invention. For instance, the steps may be performed in a differing order, or steps may be added, deleted or modified. All of these variations are considered a part of the claimed invention.

While one or more embodiments have been shown and described, modifications and substitutions may be made thereto without departing from the spirit and scope of the invention. Accordingly, it is to be understood that the present invention has been described by way of illustrations and not limitation.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An apparatus configured to hydraulically fracture an earth formation, the apparatus comprising:

a pump configured to hydraulically fracture the earth formation by pumping a fracturing liquid into a borehole penetrating the earth formation;

an electric motor having a rotor coupled to the pump and a stator; and a motor control center having an input side in communication with a source of electrical power which is at a fixed phase and frequency, an outlet side in communication with the electric motor so that the electrical power between the input side and outlet side, and at the outlet side, is at the fixed phase and frequency.

2. The apparatus according to claim 1, wherein the electric motor is a multiple-phase induction motor.

3. The apparatus according to claim 1, further comprising a hydraulic coupling configured to couple the electric motor to the pump.

4. The apparatus according to claim 1, wherein the rotor comprises a plurality of poles and the motor control center comprises pole-switching circuitry configured to switch a configuration of the poles in the plurality for multispeed operation of the electric motor.

5. The apparatus according to claim 4, wherein the pole-switching circuitry is configured to switch the poles into a first configuration for starting the electric motor and into a second configuration after the electric motor reaches a selected speed.

6. The apparatus according to claim 5, wherein the electric motor comprises a plurality of electric motors with each electric motor in the plurality being coupled to one or more pumps.

7. The apparatus according to claim 6, further comprising a controller configured to control the pole changing circuitry in order control a speed of each electric motor in the plurality of electric motors to provide a selected total flow rate that is a sum of all individual pump flow rates of pumps coupled to the plurality of electric motors.

8. The apparatus according to claim 1, wherein the pump, the electric motor and the motor control center are disposed on a mobile platform.

9. The apparatus according to claim 8, wherein the mobile platform is a trailer configured for operation on public roads.

10. The apparatus according to claim 1, wherein the fixed-frequency alternating electrical voltage is supplied by a power source and is applied directly to the stator by the motor control center and the apparatus does not include an intermediate transformer between the power source and the stator.

11. The apparatus according to claim 1, further comprising dynamic braking circuitry configured to dynamically brake the electric motor.

12. The apparatus according to claim 1, wherein the pump comprises two pumps and the electric motor comprises two output shafts, each output shaft being coupled separately to one of the pumps.

13. A method for performing hydraulic fracturing of an earth formation, the method comprising:

receiving electrical power from a power source at a motor control center of an electric motor;

transferring the electrical power from the motor control center to the electric motor so that a phase and a frequency of the electrical power at the electric motor is the same as a phase and a frequency of the electrical power at the power source;

applying the electrical power to a stator of an electric motor having a rotor coupled to a pump configured to pump a liquid into a borehole penetrating the earth formation; and pumping the liquid into the earth formation using the pump to hydraulically fracture the earth formation.

14. The method according to claim 13, further comprising turning a hydraulic coupling coupled to the pump with the rotor.

15. The method according to claim 13, wherein the rotor comprises a plurality of poles and the method further comprises changing a rotational speed of the motor by switching a configuration of the poles using pole-switching circuitry.

16. The method according to claim 15, wherein the electric motor comprises a plurality of electric motors with each electric motor in the plurality being coupled to one or more pumps and the method further comprises controlling the pole changing circuitry using a controller in order control a speed of each electric motor in the plurality of electric motors to provide a selected total flow rate that is a sum of all individual pump flow rates of pumps coupled to the plurality of electric motors.

17. The method according to claim 13, further comprising applying the fixed-frequency alternating electrical voltage supplied by a power source directly to the stator without using an intermediate transformer between the power source and the stator.

18. The method according to claim 13, further comprising dynamically braking the electric motor in order to reduce rotational speed of the electric motor using dynamic braking circuitry.

19. The method according to claim 13, further comprising correcting the power-factor of the electric motor using power-factor correction circuitry.

* * * * *